US005394794A

United States Patent [19]

Arcotta

[11] Patent Number: 5,394,794

[45] Date of Patent: Mar. 7, 1995

[54] AUTOMATIC INKING MECHANISM FOR TAPE CARTRIDGE PRINTING MACHINES

[76] Inventor: John Arcotta, 7647 W. Yucca St., Peoria, Ariz. 85345

[21] Appl. No.: 176,954

[22] Filed: Jan. 3, 1994

[51] Int. Cl.[6] ..... B41F 17/20

[52] U.S. Cl. ..... 101/43; 101/42; 101/321

[58] Field of Search ..... 101/43, 364, 365, 367, 101/42, 321, 34, 25, 40, 41, 44, 320, DIG. 38

[56] References Cited

U.S. PATENT DOCUMENTS 4,332,196 6/1982 Braun ..... 101/365
4,454,617 6/1984 Moates et al. ..... 101/364
4,480,548 11/1984 Rebel et al. ..... 101/364
5,121,687 6/1992 Arcotta ..... 101/43
5,335,596 8/1994 DeMoore et al. ..... 101/367

*Primary Examiner*—Edgar S. Burr
*Assistant Examiner*—John S. Hilten
*Attorney, Agent, or Firm*—John P. McGonagle

[57] ABSTRACT

An automatic ink feeding mechanism for tape cartridge printing machines. The mechanism is positioned over the a print inking system. On a timed basis, ink is dispensed from ink barrel reservoirs onto the driver roller. A reversing roller abutting the driver roller spreads the ink evenly across the driver roller. The driver roller then transfers ink evenly to the form roller which in turn transfers the ink to the inking roller for inking of the printing die.

8 Claims, 7 Drawing Sheets

AUTOMATIC INKING MECHANISM FOR TAPE CARTRIDGE PRINTING MACHINES

BACKGROUND OF THE INVENTION

The present invention relates to printing machines, and more particularly to automatic inking systems for cassette tape cartridge direct ink printing machines.

In the past, printing on cassette tape cartridges was generally accomplished by preprinting labels and affixing the labels to the cassettes. Printing directly onto cassettes was generally avoided because of the difficulties involved. Cassette cases are generally made of a thin plastic which tends to bend when a fixed pressure, such as from a print head, is applied. Furthermore, one side of a cassette is open for access to the enclosed tape by a tape player. The cassette opening case depth is increased to accommodate this opening thereby presenting a printing surface which is not flat. The effect of these two structural attributes of cassettes was that printing directly onto cassette generally resulted in a distorted, smudged and/or unfocused print image.

In more recent times, several machines were developed to print directly onto cassettes. The machines developed generally used offset printing processes and/or tapes. Offset printing onto cassettes requires many moving parts and results in complex and costly printing machines.

To overcome these problems applicant developed a cassette tape cartridge direct ink printing machine, for which U.S. Pat. No. 5,121,687 was issued on Jun. 16, 1992. Said patent ('687) is incorporated herein by reference. The '687 machine combined a vertical cassette cartridge feed mechanism with a unique inking system and direct printing process. Ink rather than tapes was used. The complexity and expense of offset printing and tapes was thereby eliminated.

Application of ink to the '687 machine is done by manually applying a paste ink to the '687 ductor roller 113. One ink application generally lasts for 300 cassettes, with 5 lines of print each. Because of the success of the '687 machine in continuously printing cassettes, the need to interrupt operation to apply the ink paste is inefficient.

SUMMARY OF THE INVENTION

In view of the foregoing inking disadvantage inherent in the '687 machine, the present invention provides an improvement to the '687 printing machine, by automating the application of ink to the machine. As such, the general purpose of the present invention, which will be described subsequently in greater detail, is to provide a new and improved print inking system which eliminates the need to manually interrupt printing operation to apply paste ink.

The present invention accomplishes this by providing an automatic ink feeding system, positioned over the '687 print inking system. On a timed basis, ink is dispensed from ink barrel reservoirs onto the driver roller. A reversing roller abutting the driver roller spreads the ink evenly across the driver roller. The driver roller then transfers ink evenly to a form roller (termed a "ductor" roller in '687) which in turn transfers the ink to an inking roller (termed a "form" roller in '687) for inking of the printing die.

These together with other objects of the invention, along with various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE PREFERRED EMBODIMENT

Figure 1:
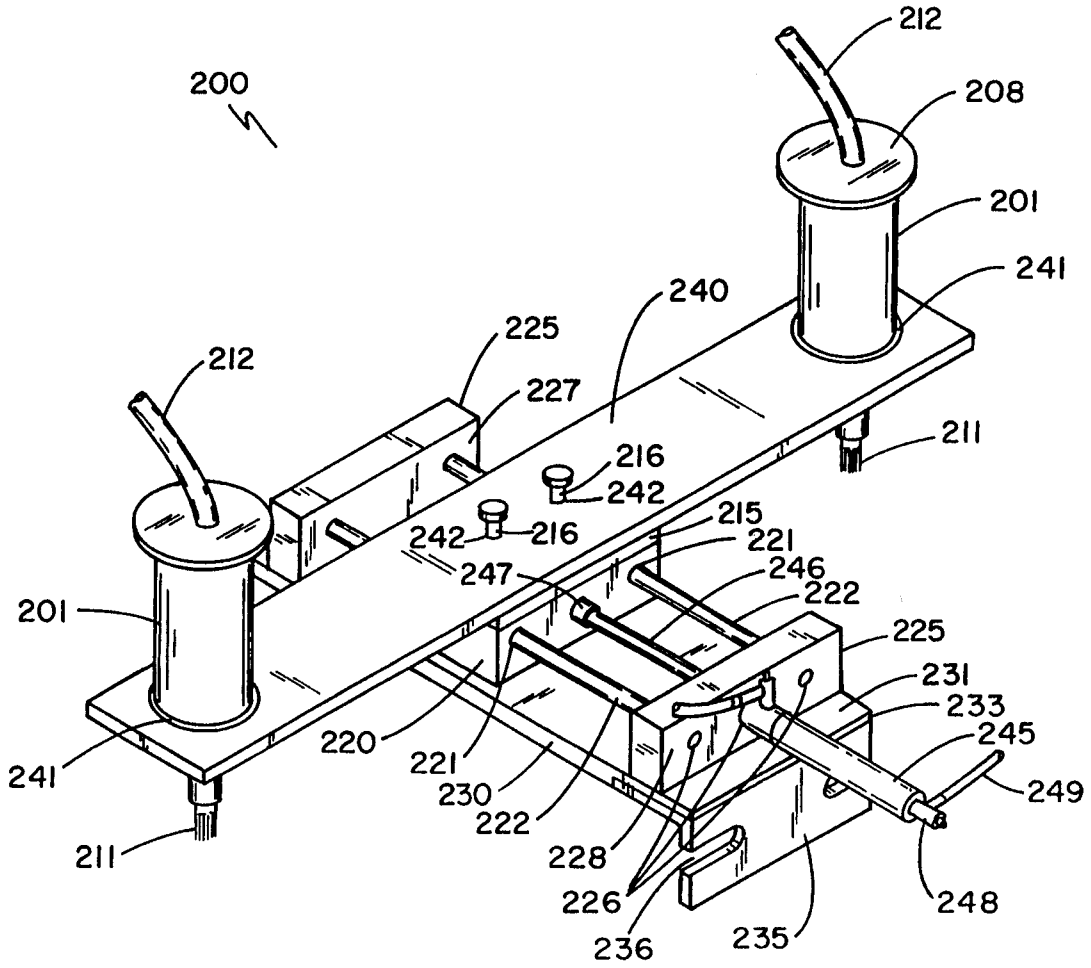
FIG. 1 is a perspective view of an automatic inking mechanism constructed according to the principles of the present invention.

Referring to the drawings in detail wherein like elements are indicated by like numerals, there is shown an embodiment of the automatic inking mechanism for use with a cassette tape cartridge direct ink printing machine of the type disclosed in applicant's U.S. Pat. No. 5,121,687, issued on Jun. 16, 1992.

The '687 machine 1 has five major components: cassette feed assembly 10, printing assembly 70, print inking system 110, drive and control system 130, and dryer station 170. For purposes of this application, the '687 patent description is incorporated by reference. In the '687 machine the die 92 in the printing assembly 70 is inked by the print inking system 110. The '687 print inking system 110 is comprised primarily of a driver roller 112, a form roller 113, an oscillating roller 114, and an inking roller 115. The inking roller 115 inks the die 92 in the print head subassembly 90. The inking roller 115 is mounted between two vertical rod cylinders 160, each of which is positioned between a plate bracket 120 and the rail conveyancer 40. The inking roller 115 is positioned rearward of, parallel to, and against the form roller 113. The inking roller 115 inks the die 92 by moving in a vertical motion over the rubber die plate 92 in a free rolling motion. In the "up" position, the inking roller 115 engages the form roller 113 and is re-inked on contact. As the inking roller 115 moves to the "down" position, it travels across and against the die 92 thereby re-inking the die 92. The inking roller 115 moves vertically on the two vertical rod cylinders 160 each of which has speed controls. The inking roller 115 moves vertically down and up across the die 92 during the advance feeder mechanism 50 stroke while the print head subassembly piston 146 is in the fully retracted position. To ink the inking roller 115, a paste ink is applied to the driver roller 112. The ink paste is a specially formulated ink for printing on plastic. The driver roller 112 initially distributes the ink paste over the form roller 113.

The present invention addresses itself to modifications to the '687 print inking system 110, whose reference numerals will be used unless specifically modified or changed by the present invention. In the '687 machine the die 92 is inked by the print inking system 110. The '687 print inking system 110 is comprised primarily of a driver roller 112, a form roller 113, an oscillating roller 114, and a inking roller 115. The print inking system 110' of the present invention also encompasses a driver roller 112', a form roller 113', and a inking roller 115' in the same configuration as the '687 machine. However, the '687 oscillating roller 114, is replaced by a reversing roller assembly 250. An automatic ink feeding system 200 is mounted over the '687 print inking system 110'.

Figure 2:
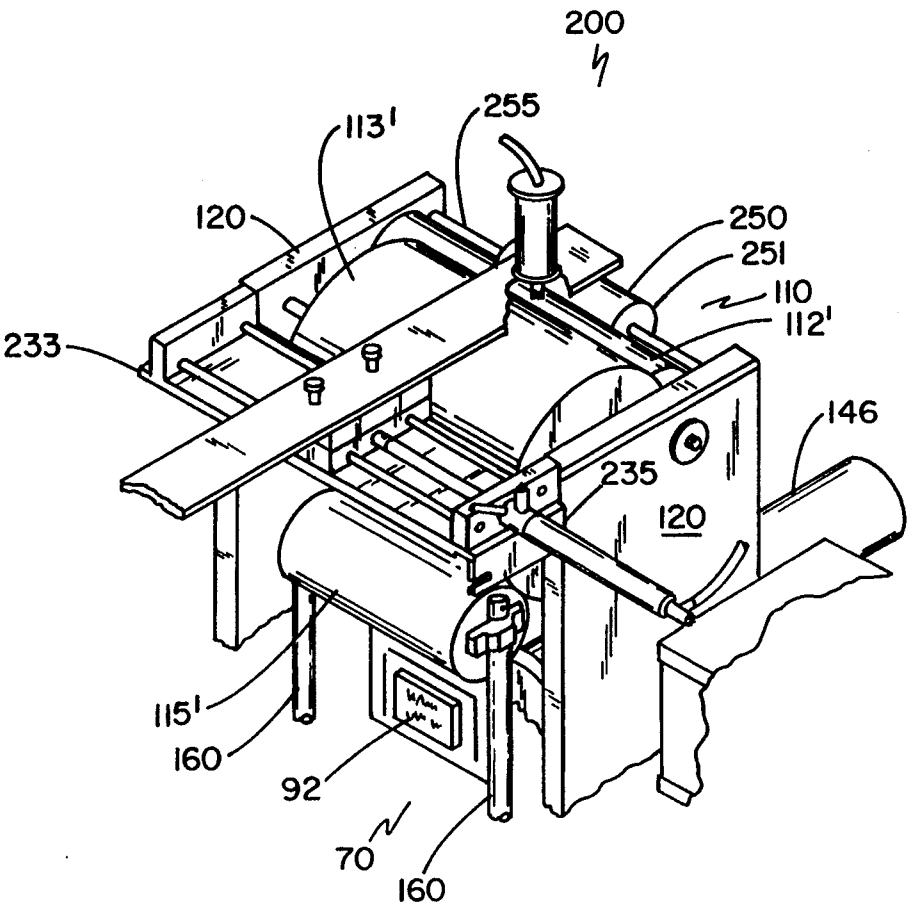
FIG. 2 is a perspective view, partly in section, of the automatic inking mechanism of FIG. 1 installed on a tape cartridge printing machine.
Figure 3:
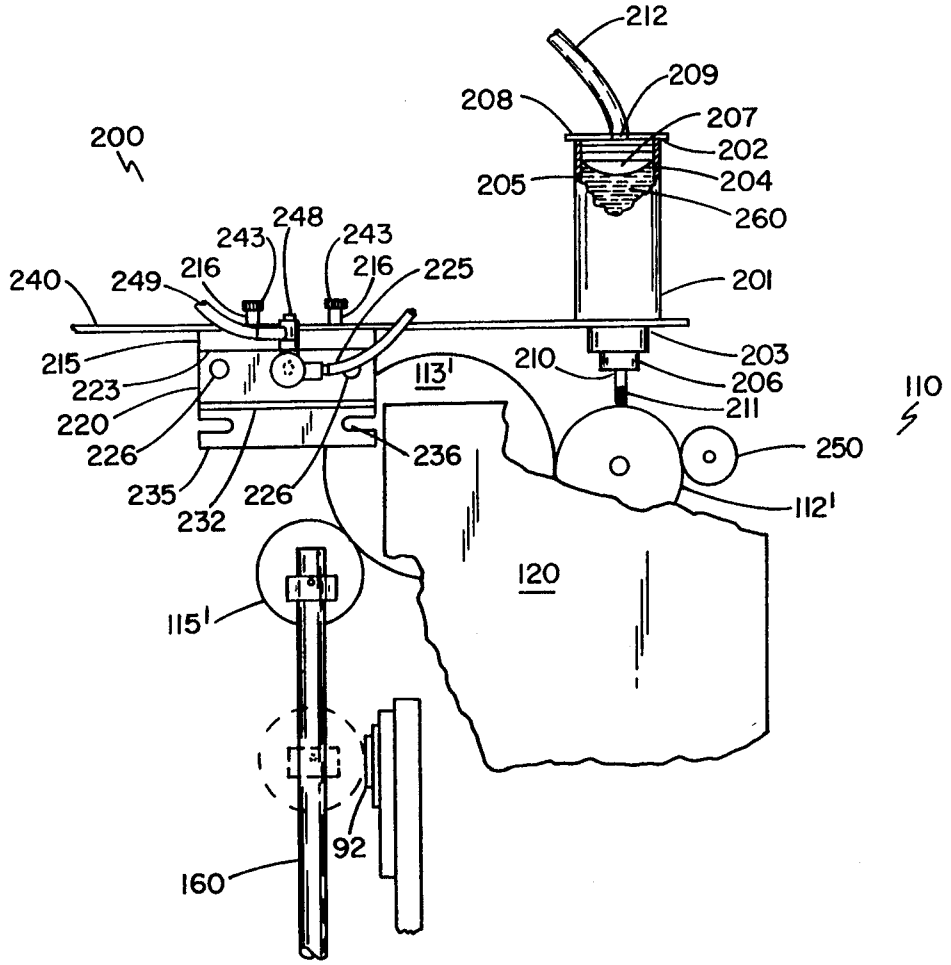
FIG. 3 is a side view of the automatic inking mechanism of FIG. 2, partly in section.
Figure 4:
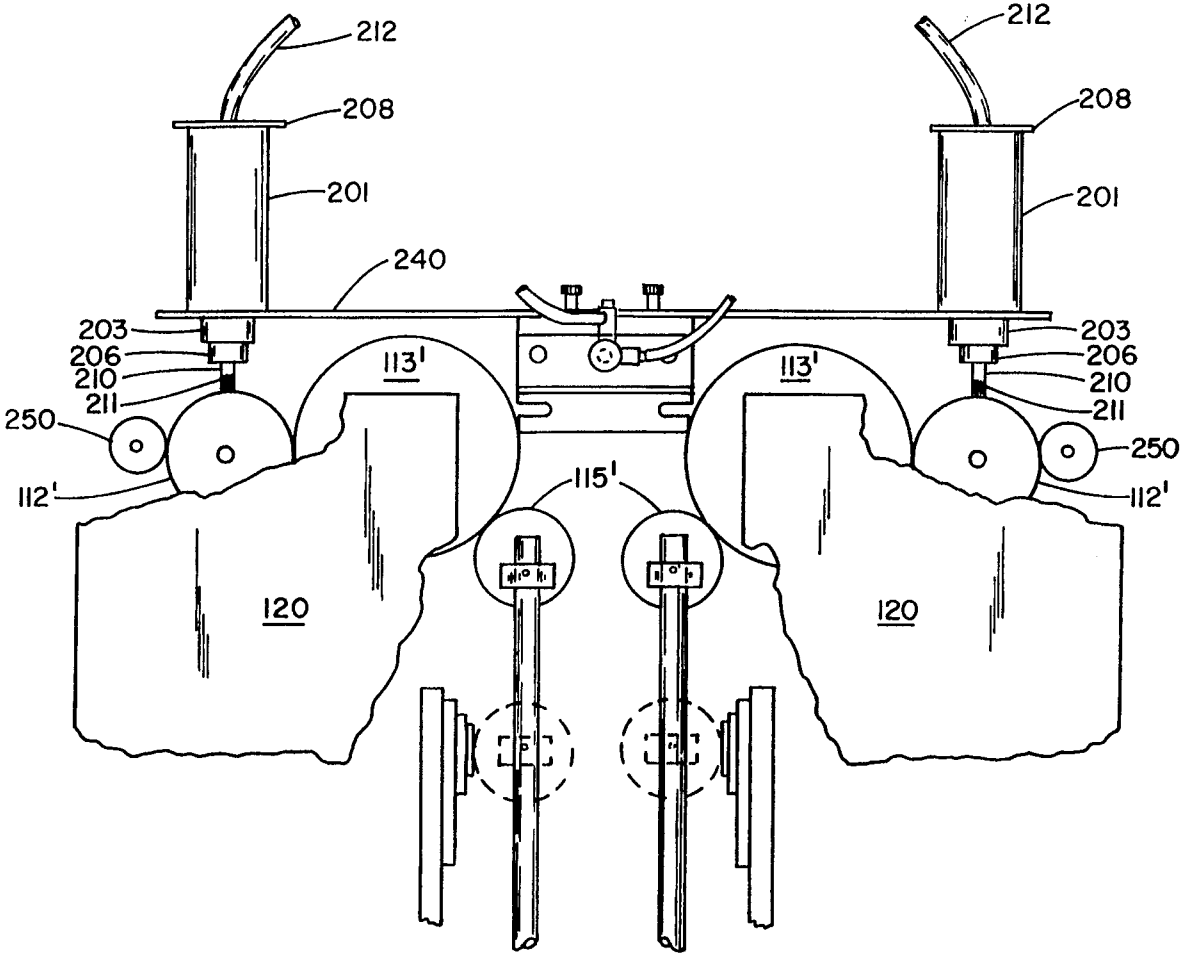
FIG. 4 is a side view of the automatic inking mechanism of FIG. 3 assembled for two-sided printing.
Figure 5:
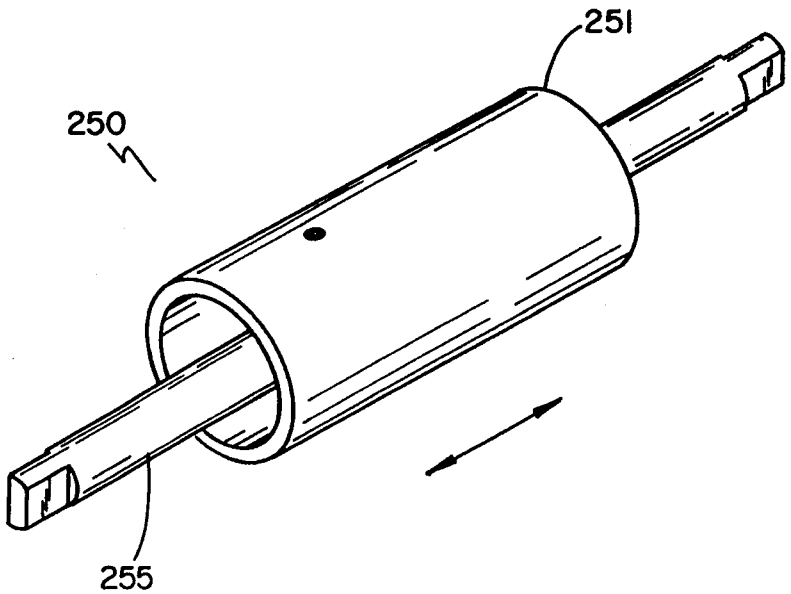
FIG. 5 is a perspective view of the reversing roller.
Figure 6:
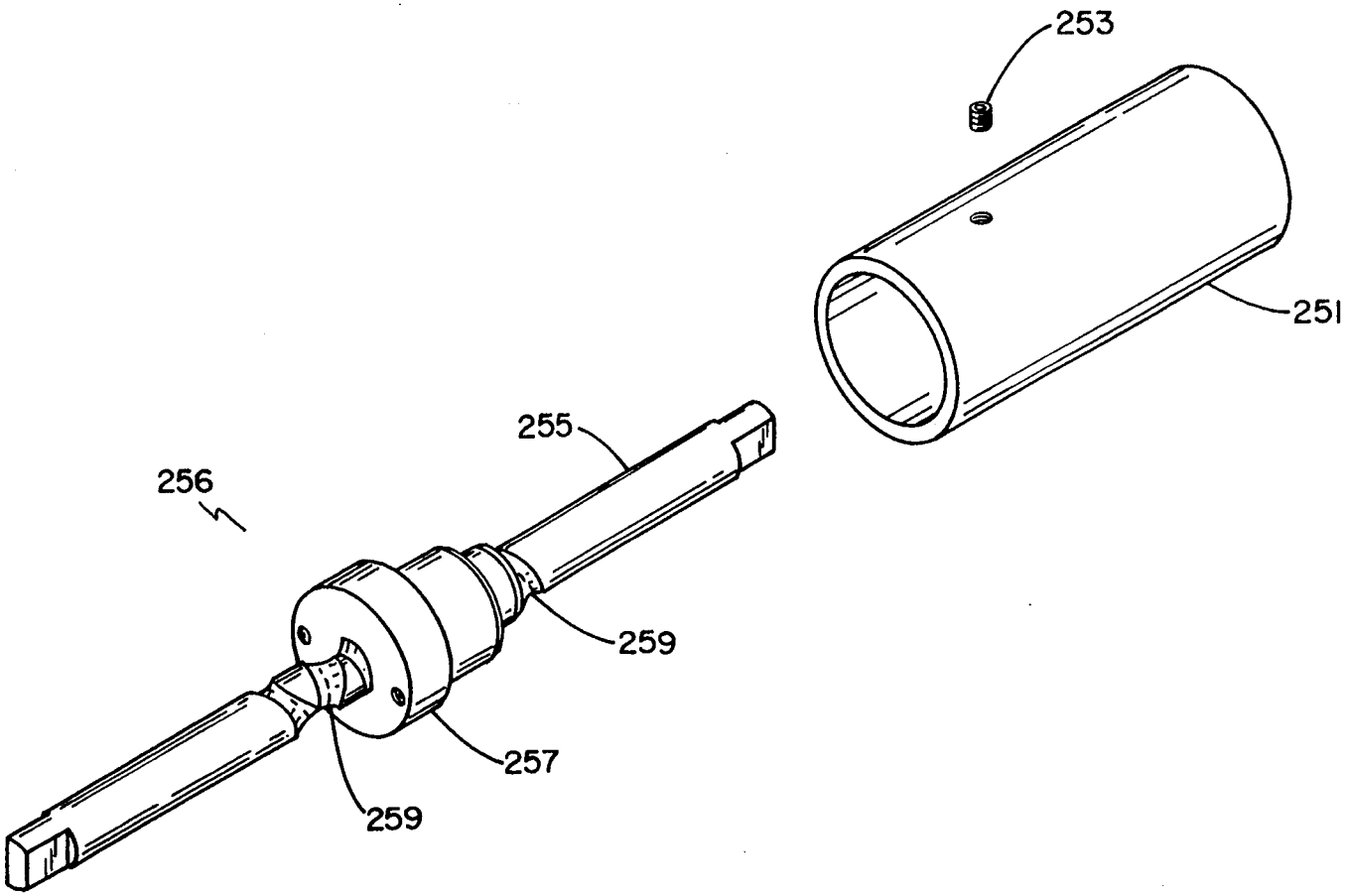
FIG. 6 is a partially exploded view of the reversing roller of FIG. 5.
Figure 7:
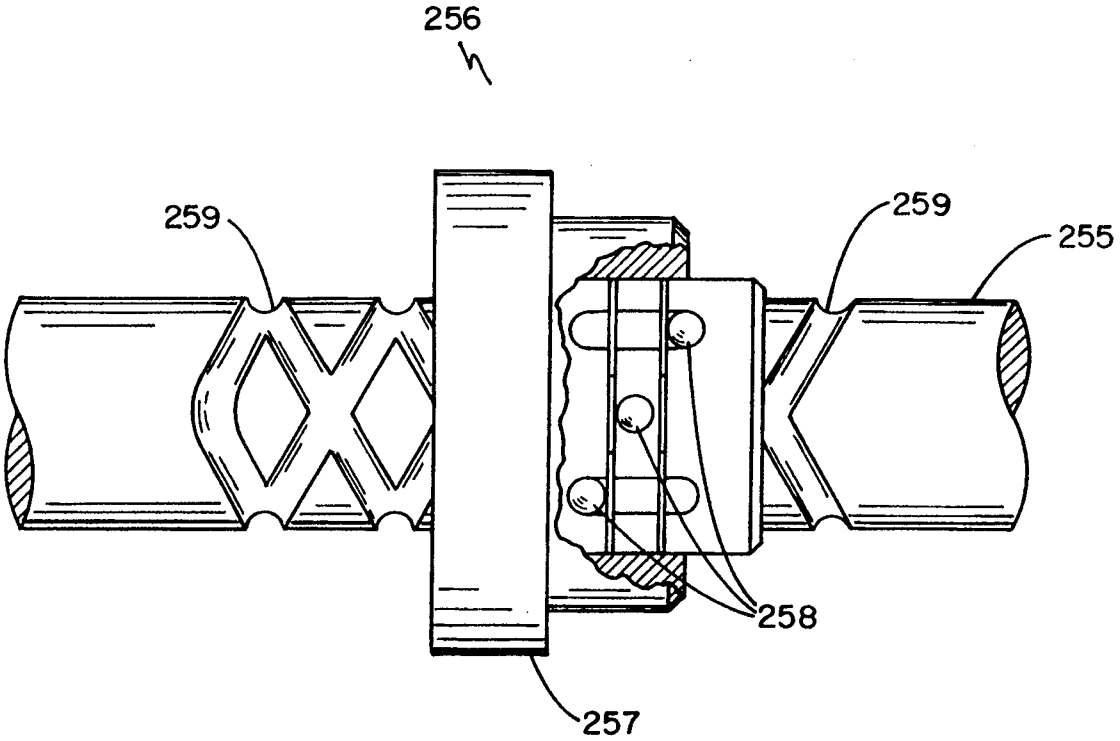
FIG. 7 is a top plan view of the reversing roller assembly shaft.

The automatic ink feeding system 200 includes one or more ink barrel cylindrical retainers 201 mounted on a barrel holding plate 240. The number of retainers 201 corresponds to the number of print inking systems 110. FIGS. 1 and 4 illustrate an automatic ink feeding system 200 for two-sided printing, each side having a separate print inking system 110. FIGS. 2 and 3 show one-sided configurations. The barrel holding plate 240 has openings (not shown) for insertion of rubber grommets 241 through which the barrel retainers 201 are partially inserted and held in place. The barrel retainers 201 are each positioned over a driver roller 112' so that the retainer longitudinal axis lies in a vertical plain transverse to the longitudinal axis of the driver roller 112'. The barrel holding plate 240 is fixedly attached to a standoff shim 215 which in turn is attached to a slide mechanism 220. The slide mechanism 220 is a generally square block with two parallel holes 221 formed therein from one end to the other. A bushing (not shown) is inserted into each hole and a shaft 222 is inserted through each bushing. Each shaft 222 is made from a $\frac{1}{4}''$ stainless steel rod. The shafts 222 are the same length and are joined at each end to a rod cylinder bracket 225. The two rod cylinder brackets 225 are attached to a rectangular main mounting plate 230 made from $\frac{1}{4}''$ thick aluminum with a width of three inches. Each end of the main mounting plate 230 terminates in a downwardly extending mounting bracket 235. The mounting brackets 235 are attached to the '687 plate bracket 120.

Each ink barrel retainer 201 has a top end 202 and a bottom end 203, and concentrically positioned within a cylindrical ink barrel reservoir 204, containing paste ink 260, which protrudes through the retainer bottom 203. A cylindrical, plug-like plunger 207 having a diameter slightly less than that of the reservoir 204 is placed within and at the top end 205 of the reservoir 202. A retainer cap 208 is attached to the retainer top end 202 thereby sealing the retainer top end 202. The cap 208 has a central aperture 209 to which is attached one end of a connecting air hose 212. The other end of the air hose 212 is connected to the '687 pneumatic drive and control system 130. The bottom end 206 of the reservoir 204 terminates in a tip adaptor 210. The tip adaptor 210 had a central aperture (not shown) opening into the reservoir interior. The tip adaptor 210 also has a small brush 211 attached thereto.

Each ink barrel retainer 201 is positioned within the barrel holding plate 240 so that its brush 211 is just touching its corresponding driver roller 112'. Air pressure through the hose 212 forces the plunger 207 downward against the ink 260 within the reservoir 204. The downward pressure forces paste ink out the reservoir bottom end 206 through the tip adaptor 210 and brush 211 onto the driver roller 112' surface.

The main mounting plate 230 is horizontally positioned rearward and slightly above the form roller 113'. In a two-sided printing system, the plate 230 is centered slightly above and between the form rollers 113'. The longitudinal axis of the mounting plate 230 is parallel to the longitudinal axis of the form roller 113'. The mounting plate 230 has an upper surface 231, a lower surface 232, and two ends 233. A downwardly extending, flange-like, generally rectangular, mounting bracket 235 is attached at right angles to the plate lower surface 232 at each plate end 233. The mounting brackets 235 are slotted on each side 236 for forward and rearward adjustment of the main mounting plate 230 position. The mounting brackets 235 are attached directly to the '687 plate brackets 120'.

An upwardly extending, flange-like, generally rectangular, rod cylinder bracket 225, having an interior side 227 and an exterior side 228, is attached at right angles to the plate upper surface 231 near to each plate end 233. The interior sides 227 of each bracket 225 are defined as those facing the other bracket 225. The exterior side of each bracket 228 is defined as the other side of the same bracket 228. Each bracket 225 has three parallel, cylindrical holes 226 formed therein. The longitudinal axis of each hole 226 lies in parallel to the longitudinal axis of the main mounting plate 230. The outer holes 226 of each opposite bracket 225 are interconnected on their interior sides 227 by means of $\frac{1}{4}''$ stainless steel shafts 222 press fitted at each end into the corresponding bracket holes 226. A generally rectangular, block-like, slide mechanism 220 with two parallel, cylindrical holes 221 formed therein and containing press-fitted bushings (not shown) is positioned between the two rod cylinder brackets 225. The shafts 222 are positioned through the bushings in the slide mechanism holes 221 so that the slide mechanism 220 is slidably movable along the shafts 222 from bracket 225 to opposite bracket 225. The central hole 226 of each bracket 225 has a 4" stroke pneumatic air, three-quarter inch bore, double-acting cylinder 245 screwed into the exterior side 228 of one of the rod cylinder brackets 225. The pneumatic cylinder's piston 246 is positioned through the bracket central hole 226. The distal end 247 of the piston 246 is attached to the slide mechanism 220, wherein movement of the piston 246 into and out of the cylinder 245 causes a corresponding movement of the slide mechanism 220. The cylinder 245 has two air flow controllers 248 screwed into each end of the cylinder 245. Air hoses 249 interconnect the air flow controllers 248 with the '687 pneumatic drive and control system 130. The drive and control system 130 thereby controls the movement of the piston 246 and thereby the side-by-side movement of the slide mechanism 220.

The slide mechanism 220 has a flat top surface 223 to which a rectangular, plate-like standoff shim 215 is fixedly attached. The shim 215 has the same general perimeter dimensions as the slide mechanism 220 but is thinner. The shim 215 has two threaded studs 216 extending upwardly from the shim's top surface (not shown).

The barrel holding plate 240 has two holes 242 formed at the plate's approximate midpoint. The holes 242 are in parallel along the plate's longitudinal axis. The holes 242 correspond to the shim studs 216. The plate 240 fits onto the shim 215 so that the shim studs 216 fit protrude through the plate central holes 242. Thumb cap screws 243 thread onto the studs 216 and hold the plate 240 fixedly to the shim 215.

In this embodiment of the invention, the '687 oscillating roller 114 is replaced by a reversing roller mechanism 250 positioned parallel to, against, and forward of the driver roller 112'. The reversing roller mechanism 250 is comprised of a stainless steel roller sleeve 251 on a shaft 255. The reversing roller sleeve 251 moves side-to-side across the shaft 255 against the face of the driver roller 112'. The function of the reversing roller mechanism 250 is to distribute or spread the ink on the drive roller 112', and thereby the form roller 113', evenly across the rollers 112', 113' as ink 260 is removed during the printing process and as ink is added from the automatic ink feeding system 200. Rotation of the reversing roller sleeve 251 is obtained from pressure against the driver roller 112' which in turn is driven by the '687 motor 150.

As may be seen from FIGS. 2, and 5–7, the shaft is attached at each end to the plate bracket 120. The shaft 255 is grooved along a central portion 256. A generally cylindrical cage 257 with central opening and internal ball bearings 258 is mounted on the shaft central portion 256. The central portion grooves 259 are so designed that rotation of the cage 257 will cause the ball bearings 258 to track along the grooves 259. As the cage 257 rotates, the ball bearing interaction with the grooves 259 will cause the cage 257 to move longitudinally along the shaft 255. When the cage 257 reaches the end of the grooved portion 256 the track of the ball bearings 258 along the grooves 259 will cause the cage 257 to reverse direction. The sleeve 251 is fitted over the cage 257 and attached thereto with a set screw 253 installed inside the sleeve 251. As the driver roller 112' causes the sleeve 251 to rotate, the cage 257 also will turn. As the cage 257 turns, it will move longitudinally along the shaft 255 and thereby cause the sleeve 251 to also move along the shaft 255.

In operation the barrel holding plate 240 and ink barrel reservoirs 204 are moved from side to side in time with each print cycle. The reservoir brushes 211 move across the surface of the driver rollers 112' spreading ink 260 longitudinally across the rollers 112'. The reversing roller assemblies 250 continue to spread the ink 260 over the entire driver roller 112'. Ink 260 is metered out of each reservoir 204 through the tip adapters 210 approximately once each 200 print cycles. The quantity, duration and timing at which ink 260 is dispensed is determined by programming the main control system 130 for desired quantity, duration and timing of dispensing of ink 260. The need to manually interrupt the operation of the printing machine for inking operations is eliminated with the present invention.

It is understood that the above-described embodiment is merely illustrative of the application. Other embodiments may be readily devised by those skilled in the art which will embody the principles of the invention and fall within the spirit and scope thereof.

I claim:

1. An improved cassette tape cartridge direct ink printing machine of the type having:

a base plate;

a cassette tape cartridge feeding assembly mounted on said base plate comprised of a cassette supply chute, a rail conveyancer assembly perpendicularly joined to said supply chute, and a feeder mechanism for moving cassettes from said supply chute into and along said rail conveyancer;

a printing assembly mounted on said base plate comprised of a print head subassembly and back pressure plate subassembly juxtaposed on opposite sides of said rail conveyancer in position to operate on cassettes within said rail conveyancer;

a print inking system mounted on said base plate above said print head subassembly comprised of two parallel plate brackets each one positioned on one side of said print head subassembly, a cylindrical driver roller attached to said brackets and having a central longitudinal axis positioned in parallel with said rail conveyancer, means to radially drive said roller, a form roller attached to said brackets and positioned against and in parallel to said driver roller between said roller and said rail conveyancer, an inking roller positioned below and in parallel to said form roller and mounted between two vertical rod cylinders positioned between said plate brackets and said rail conveyancer whereby said inking roller moves in a vertical motion on said rod cylinders and engages said form roller at the apogee of its upward motion and rolls across the face of said print head subassembly during its downward motion; and a reversing roller mechanism mounted on a bracket mounted on the top side of parallel brackets housing said rod cylinders wherein said reversing roller mechanism is positioned parallel to and against said driver roller;

wherein the improvement comprises an automatic ink feeding mechanism, mounted over said print inking system and attached to said parallel plate brackets, comprised of:

a main mounting plate horizontally positioned rearward and slightly above the form roller, having a longitudinal axis parallel to the longitudinal axis of the inking roller, said mounting plate having an upper surface, a lower surface, and two ends;

a downwardly extending, flange-like, generally rectangular, mounting bracket attached at right angles to the plate lower surface at each plate end, said mounting brackets being slotted on each side for forward and rearward adjustment of the main mounting plate position, said mounting brackets being attached directly to the said plate brackets;

an upwardly extending, flange-like, generally rectangular, rod cylinder bracket, having an interior side and an exterior side, attached at right angles to the plate upper surface near to each plate end, the interior sides of each bracket being defined as those facing the other bracket, and the exterior side of each bracket being defined as the other side of the same bracket, each bracket having three parallel, cylindrical holes formed therein, the longitudinal axis of each hole being in parallel to the longitudinal axis of the main mounting plate, the outer holes of each opposite bracket being interconnected on their interior sides by means of shafts press fitted at each end into the corresponding bracket holes;

a generally rectangular, block-like, slide mechanism with a flat top surface, having two parallel, cylindrical holes formed therein and containing press-fitted bushings, positioned between the two rod cylinder brackets, said shafts being positioned through the bushings in the slide mechanism holes wherein the slide mechanism is slidably movable along the shafts from bracket to opposite bracket;

a pneumatic, double-acting cylinder, with reciprocating piston, and having small openings at each end, screwed into the exterior side of one of the rod cylinder brackets, wherein the pneumatic cylinder's piston is extended through the bracket central hole, wherein the distal end of the piston is attached to the slide mechanism, wherein movement of the piston into and out of the cylinder causes a corresponding movement of the slide mechanism;

a rectangular, plate-like standoff shim, having a top surface, fixedly attached to the slide mechanism flat top surface, said shim having two threaded studs extending upwardly from its top surface;

a rectangular barrel holding plate with two holes formed at the plate's approximate midpoint, and two circular openings near to its ends, said holes being in parallel along the plate's longitudinal axis and corresponding to the shim studs, wherein the plate fits onto the shim so that the shim studs protrude through the plate central holes;

thumb cap screws thread onto the studs whereby said plate is fixedly attached to said shim;

a rubber grommet inserted into each said barrel holding plate circular opening;

one or more ink barrel cylindrical retainers, having a top end and a bottom end, partially inserted and held in place in said barrel holding plate circular openings, said barrel retainers each positioned over a driver roller so that the retainer longitudinal axis lies in a vertical plain transverse to the longitudinal axis of a driver roller;

a cylindrical ink barrel reservoir, containing paste ink within an interior portion, and having a top end and a bottom end, concentrically positioned within a retainer, said reservoir protruding through the retainer bottom, said reservoir bottom end terminating in a tip adaptor, said tip adaptor having a central aperture opening into the reservoir interior portion, said tip adaptor also having a small brush attached thereto, each ink barrel retainer being positioned within the barrel holding plate so that said tip adapter brush is just touching its corresponding driver roller;

a cylindrical, plug-like plunger having an outside diameter slightly larger than that of the inside dimension of the reservoir placed within and at the top end of the reservoir; and a retainer cap, having a central aperture to which is attached one end of a connecting air hose, sealingly attached to the retainer top end, wherein the other end of the air hose is connected to pneumatic drive and control means.

2. An improved printing machine as recited in claim 1, further comprising:

an air flow controller screwed into each small opening of the cylinder; and air hoses interconnecting said air flow controllers with pneumatic drive and control means.

3. An improved printing machine as recited in claim 2, wherein said reversing roller mechanism is comprised of:

a shaft attached at each end to the plate bracket, said shaft being grooved along a central portion;

a generally cylindrical cage with central opening and internal ball bearings mounted on the shaft central portion, wherein the central portion grooves are so designed that rotation of the cage will cause the ball bearings to track along the grooves, wherein as the cage rotates, the ball bearing interaction with the grooves causes the cage to move longitudinally along the shaft and when the cage reaches the end of the grooved portion the track of the ball bearings along the grooves will cause the cage to reverse direction;

a cylindrical sleeve fitted over the cage and attached thereto with a set screw installed inside the sleeve.

4. An improved printing machine as recited in claim 3, wherein:

the reversing roller sleeve moves side-to-side across the shaft against the face of the driver roller, rotation of the reversing roller sleeve being obtained from adjustable pressure against the driver roller, with a travel side-to-side of one and one-half inches, each way of center.

5. An improved cassette tape cartridge direct ink printing machine of the type having:

a base plate;

a cassette tape cartridge feeding assembly mounted on said base plate comprised of a cassette supply chute, a rail conveyancer assembly perpendicularly joined to said supply chute, and a feeder mechanism for moving cassettes from said supply chute into and along said rail conveyancer;

a printing assembly mounted on said base plate comprised of two print head subassemblies juxtaposed on opposite sides of said rail conveyancer in position to operate on cassettes within said rail conveyancer;

two print inking systems mounted on said base plate each positioned above a print head subassembly and each comprised of two parallel plate brackets each one positioned on one side of a print head subassembly, a cylindrical driver roller attached to said brackets and having a central longitudinal axis positioned in parallel with said rail conveyancer, means to radially drive said roller, a form roller attached to said brackets and positioned against and in parallel to said driver roller between said roller and said rail conveyancer, an inking roller positioned below and in parallel to said form roller and mounted between two vertical rod cylinders positioned between said plate brackets and said rail conveyancer whereby said inking roller moves in a vertical motion on said rod cylinders and engages said form roller at the apogee of its upward motion and rolls across the face of said print head subassembly during its downward motion; and two reversing roller mechanisms each mounted on a bracket mounted on the top side of parallel brackets housing said rod cylinders wherein each reversing roller mechanism is positioned parallel to and against said driver rollers;

wherein the improvement comprises an automatic ink feeding mechanism, mounted over said print inking systems and attached to said parallel plate brackets, comprised of:

a main mounting plate horizontally centered slightly above and between the form rollers, having a longitudinal axis parallel to the longitudinal axis of the inking rollers, said mounting plate having an upper surface, a lower surface, and two ends;

a downwardly extending, flange-like, generally rectangular, mounting bracket attached at right angles to the plate lower surface at each plate end, said mounting brackets being slotted on each side for forward and rearward adjustment of the main mounting plate position, said mounting brackets being attached directly to the said plate brackets;

an upwardly extending, flange-like, generally rectangular, rod cylinder bracket, having an interior side and an exterior side, attached at right angles to the plate upper surface near to each plate end, the interior sides of each bracket being defined as those facing the other bracket, and the exterior side of each bracket being defined as the other side of the same bracket, each bracket having three parallel, cylindrical holes formed therein, the longitudinal axis of each hole being in parallel to the longitudinal axis of the main mounting plate, the outer holes of each opposite bracket being interconnected on their interior sides by means of shafts press fitted at each end into the corresponding bracket holes;

a generally rectangular, block-like, slide mechanism with a flat top surface, having two parallel, cylindrical holes formed therein and containing press-fitted bushings, positioned between the two rod cylinder brackets, said shafts being positioned through the bushings in the slide mechanism holes wherein the slide mechanism is slidably movable along the shafts from bracket to opposite bracket;

a pneumatic, double-acting cylinder, with reciprocating piston, and having small openings at each end, screwed into the exterior side of one of the rod cylinder brackets, wherein the pneumatic cylinder's piston is extended through the bracket central hole, wherein the distal end of the piston is attached to the slide mechanism, wherein movement of the piston into and out of the cylinder causes a corresponding movement of the slide mechanism;

a rectangular, plate-like standoff shim, having a top surface, fixedly attached to the slide mechanism flat top surface, said shim having two threaded studs extending upwardly from its top surface;

a rectangular barrel holding plate with two holes formed at the plate's approximate midpoint, and two circular openings near to its ends, said holes being in parallel along the plate's longitudinal axis and corresponding to the shim studs, wherein the plate fits onto the shim so that the shim studs protrude through the plate central holes;

thumb cap screws thread onto the studs whereby said plate is fixedly attached to said shim;

a rubber grommet inserted into each said barrel holding plate circular opening;

two ink barrel cylindrical retainers, having a top end and a bottom end, partially inserted and held in place in said barrel holding plate circular openings, said barrel retainers each positioned over a driver roller so that the retainer longitudinal axis lies in a vertical plain transverse to the longitudinal axis of the driver rollers;

two cylindrical ink barrel reservoirs, containing paste ink within an interior portion, and each having a top end and a bottom end, each concentrically positioned within a retainer, said reservoir protruding through the retainer bottom, said reservoir bottom end terminating in a tip adaptor, said tip adaptor having a central aperture opening into the reservoir interior portion, said tip adaptor also having a small brush attached thereto, each ink barrel retainer being positioned within the barrel holding plate so that said tip adapter brush is just touching a corresponding driver roller;

a cylindrical, flexible, plug-like plunger having an outside diameter slightly larger than that of the inside dimension of the reservoir placed within and at the top end of each reservoir; and two retainer caps, each having a central aperture to which is attached one end of a connecting air hose, sealingly attached to each retainer top end, wherein the other end of each air hose is connected to pneumatic drive and control means.

6. An improved printing machine as recited in claim 5, further comprising:

an air flow controller screwed into each small opening of the cylinder; and air hoses interconnecting said air flow controllers with pneumatic drive and control means.

7. An improved printing machine as recited in claim 6, wherein each said reversing roller mechanism is comprised of:

a shaft attached at each end to the plate bracket, said shaft being grooved along a central portion;

a generally cylindrical cage with central opening and internal ball bearings mounted on the shaft central portion, wherein the central portion grooves are so designed that rotation of the cage will cause the ball bearings to track along the grooves, wherein as the cage rotates, the ball bearing interaction with the grooves causes the cage to move longitudinally along the shaft and when the cage reaches the end of the grooved portion the track of the ball bearings along the grooves will cause the cage to reverse direction;

a cylindrical sleeve fitted over the cage and attached thereto with a set screw installed inside the sleeve.

8. An improved printing machine as recited in claim 7, wherein:

each reversing roller sleeve moves side-to-side across the shaft against the face of the driver roller rotation of the reversing roller sleeve being obtained from adjustable pressure against the driver roller, with a travel side-to-side of one and one-half inches each way of center.

* * * * *